United States Patent [19]

Tafel

[11] Patent Number: 4,522,187

[45] Date of Patent: Jun. 11, 1985

[54] ARCHERY QUIVER AND METHOD

[76] Inventor: William G. Tafel, 2702 Trindal St., Eau Claire, Wis. 54701

[21] Appl. No.: 487,968

[22] Filed: Apr. 25, 1983

[51] Int. Cl.[3] ..... F41B 5/00; F41B 5/06

[52] U.S. Cl. ..... 124/24 A

[58] Field of Search ..... 124/45, 23 A, 24 R, 124/88, 41 A; D22/13

[56] References Cited

U.S. PATENT DOCUMENTS

| | | | |
|---|---|---|---|
| 2,909,167 | 10/1959 | Fredrickson | 124/45 X |
| 3,017,874 | 1/1962 | Gubash | 124/23 A |
| 3,366,101 | 1/1968 | Saunders | 124/23 A X |
| 3,406,675 | 10/1968 | Fredrickson | 124/45 X |
| 3,595,214 | 7/1971 | O'Malley | 128/88 X |
| 3,595,215 | 7/1971 | Wilkie | 124/24 A X |
| 3,601,113 | 8/1971 | Wilkie | 124/24 A X |
| 4,020,984 | 5/1977 | Morris | 124/24 A X |
| 4,363,312 | 12/1982 | Spitzke | 124/45 |

*Primary Examiner*—Richard J. Apley
*Assistant Examiner*—William R. Browne

[57] ABSTRACT

An archery quiver including a magazine having top and bottom clip members adapted to be mounted in fixed, longitudinally spaced apart relation on a bow to position said members respectively above and below the sighting and projection path of the arrows in a manner to present a readily accessible supply of arrows to the archer located on the projection side of the bow in sufficiently spaced relation to the bow to provide unobstructed clearance for an arrow to be released from its storage position in said clip members and shifted directly into sighting and projection position adjacent to said bow when the archer removes an arrow from the lower member and notches the arrow for sighting and shooting, the upper member being positioned forwardly of the bow and the lower member being positioned rearwardly of the bow.

A method for transferring arrows from a magazine positioned on the projection side of the bow, whereby the arrow is guided during the notching operation of the arrow in the bow string directly into sighting and projection position onto the arrow rest on the bow.

14 Claims, 5 Drawing Figures

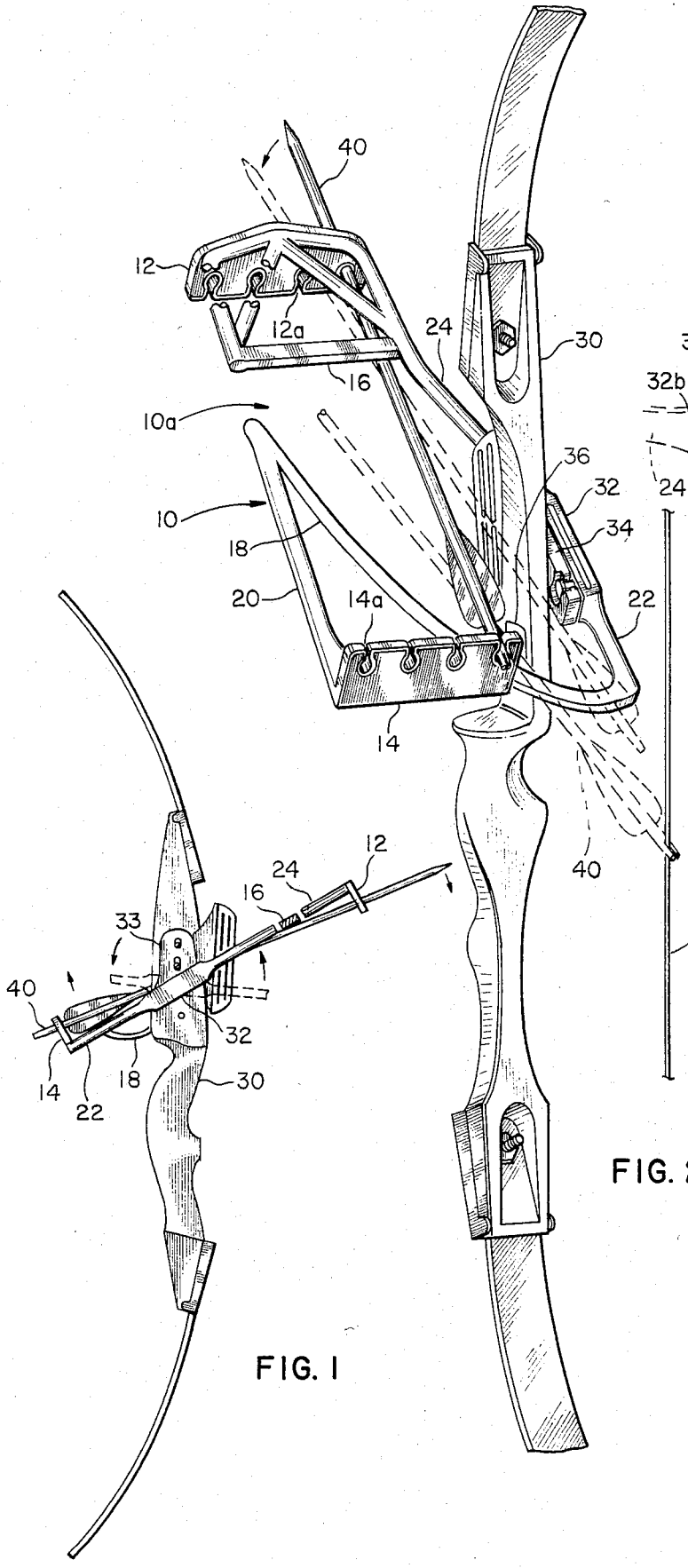
FIG. 1
FIG. 2
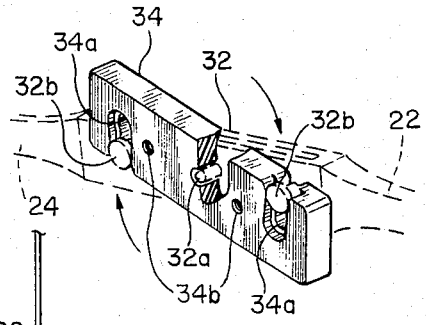
FIG. 3
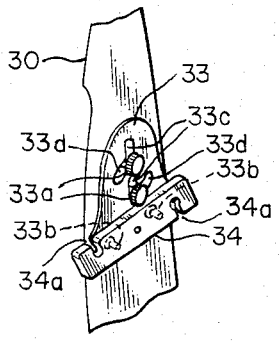
FIG. 5
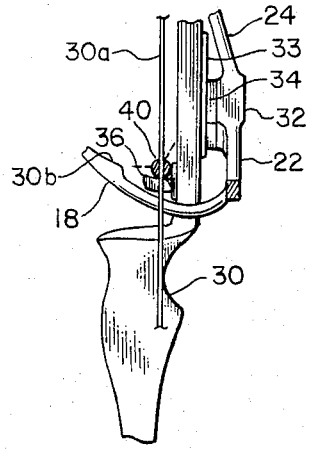
FIG. 4

ARCHERY QUIVER AND METHOD

BACKGROUND OF THE INVENTION

A number of bow-mounted quivers have been developed over the years to improve the accessibility of the supply of arrows to the archer. In order to maintain an open sighting and projection window for the arrow on one side of the bow (the left side for right-handed archers and the right side for left-handed archers), these bow-mounted quiver units have been mounted on the side of the bow opposite to the sighting and projection side and the arrow holding magazine has also been positioned on the non-projection side of the bow. This requires the archer to remove the arrow from the quiver magazine and transfer it to the projection side of the bow before notching it and positioning it on the arrow rest in its sighting and projection path on the bow. This excessive transfer movement of the arrows from one side of the bow to the other eliminates much of the convenience advantage sought to be achieved by a bow-mounted quiver.

SUMMARY OF THE INVENTION

The present invention provides a bow-mounted quiver which is particularly constructed to position the arrow-holding magazine on the projection side of the bow in a manner to permit each arrow as it is removed from the magazine to drop down directly onto the arrow rest of the bow as the archer notches the rear end of the arrow in the bow string. With very little experience, it is possible to develop the technique of removing the arrow from the magazine and notch the arrow in a single continuous motion while the front portion of the arrow drops down with the force of gravity onto the arrow rest, thus quickly completing the positional transition of the arrow from the storage magazine to the sighting and projection path on the bow. As an assist to the positioning of the arrow on the rest element of the bow, a guide member may be provided on which the intermediate portion of the arrow rides as it drops down from the upper clip member. This is also facilitated by the upper clip member being positioned above the forward portions of the arrows retained thereby and a fulcrum bar provided in spaced relation to the upper clip member, whereby removal of the rear portion of an arrow from the bottom clip member will cause a portion of the arrow to engage the under side of said bar and cam the forward portion of the arrow out of its retaining upper clip holder to free the arrow from the magazine and cause it to automatically drop into sighting and projection position on the arrow rest simultaneously with the notching of the arrow in the bow string.

The present invention also provides a method for transferring arrows from a magazine positioned on the projection side of the bow, whereby the arrow is guided during the notching operation of the arrow in the bow string, directly into sighting and projection position onto the arrow rest on the bow.

DESCRIPTION OF THE DRAWINGS

FIG. 1 is a side elevational view of a typical archery bow with my quiver mounted thereon showing the bracket twisted into release position by dotted lines;

FIG. 2 is a perspective view thereof with an arrow shown by dotted lines in the position immediately after release from the retaining recesses and also by dotted lines in its projection position on the arrow rest after being notched on the bow string;

FIG. 3 is a perspective view showing the construction of the mounting parts;

FIG. 4 is a fragmentary view partially in section showing an arrow in sighting projection position; and FIG. 5 is a fragmentary perspective view of the mounting bracket for the quiver magazine.

DETAILED DESCRIPTION OF THE PREFERRED EMBODIMENT

The bow-mounted quiver assembly embodying this invention includes a magazine unit 10 having a top arrow-holding clip member 12 and a bottom arrow-holding clip member 14. The top clip member has its resilient arrow-holding recesses 12*a* formed therein and oriented with the open ends of the recesses positioned generally downwardly to position the arrows held therein on the bottom side of said member 12. In the form shown, the lower clip member 14 has its arrow-holding recesses 14*a* extending generally upwardly and rearwardly therefrom to support the rear portions of the arrows.

In this form of the invention, the upper portion of the magazine is provided with a fulcrum cross bar 16 disposed in spaced relation below the top clip member 12. An arrow guide member 18 extends downwardly from an intermediate portion of the magazine to the rear side of the bow adjacent the sighting and projection path of the arrow. The upper end of the guide member 18 is supported by support element 20 which rigidly connects said upper end to the outer end of the bottom clip member 14 as shown. In this form, the upper ends of the guide member 18 and support member 20 which are rigidly connected, terminate in spaced relation below the cross bar 16 to provide an opening 10*a* which is sufficiently large to permit the magazine frame 10 to receive the bow 30 therethrough when the quiver is being mounted on the bow.

The magazine 10 may be connected to the bow 30 in any suitable manner such as by the bracket member 32 having a mounting plate 33. The bracket member 32 has a centering pin 32*a* and locking pins 32*b* having interlocking heads thereon. A mating bracket 34 has a centering hole and interlocking slots 34*a* for receiving the pins 32*b*. The bracket 32 is fixed to a pair of quiver supporting arms 22 and 24. The supporting arm 24 extends upwardly to the top arrow-holding clip member 12 and cross bar 16 to provide a positive connection thereof with the bow 30. The bottom arrow holding clip member 14 and guide member 18 are rigidly interconnected at the lower ends thereof and are positively connected to the bracket member 32 by the supporting arm 22.

The mounting plate 33 is attached to the bow as by a pair of attachment screws 33*a*. The mounting plate 33 is fixed to the mating bracket 34 as by a pair of screws 33*b* which are received in the threaded opening 34*b* provided in mating bracket 34 as best shown in FIG. 3. Vertically extending elongated slot portions 33*c* are provided in the plate 33 and permit vertical adjustment of the mating bracket 34 on the bow. A pair of arcuate slots 33*d* communicate with the elongated slots 33*c* and permit the plate 33 and the mounting bracket 34 to be rotated on the bow to shift the quiver arm 24 upwardly into a suitable retracted storage position with the upper clip member 12 engaged with the upper portion of the bow, thus obviating the necessity of removing the quiver from the bow and permitting the same to be easily carried and compactly stored. The attachment screws 33*a* may be in the form of conventional thumb screws for easy loosening and tightening.

The bow 30 is provided with an arrow rest 36 which is disposed slightly above the bottom of the arrow guide 18. An arrow 40 is shown notched in the bow string 30*a* in sighting projection position on the arrow rest in FIG. 4 of the drawings. The magazine 10 is mounted on the bow 30 with th upper clip member 12 disposed forwardly of the bow and the bottom clip member 14 disposed in spaced relation therebelow and rearwardly of the bow so that when the arrows are placed in the arrow-holding recesses 12*a* and 14*a*, they will lie in a plane sloping upwardly and forwardly from the bottom clip member 14. The guide member 18 slopes downwardly toward the arrow rest 36 so that when the archer lifts the rear portion of the arrow out of its lower recess 14*a*, the arrow will be immediately cammed out of its forward holding recess 12*a* by the fulcrum cross bar 16 and will drop down onto the guide member 18 and be guided toward the arrow rest 36 as the archer brings the rear portion of the arrow back into notching position on the bow string 30*a*. The space between the guide member 18 and the projection side of the bow 30 and the space between the guide member 18 and the top clip member 12 provides a sufficiently large window opening for the sighting and release of each arrow by the archer.

The method of transferring the arrows from the magazine into sighting and projection position on the bow is also an important part of this invention. This method includes the steps of providing top and bottom clip members 12 and 14 with arrow-holding recesses 14*a* on the bottom clip member and arrow-holding recesses 12*a* on the top clip member, removing the arrow from the respective recesses of the top and bottom clip members and moving the arrow rearwardly into notching position on the bow string 30*a* and guiding the arrow during its travel downwardly onto the arrow rest 36 of the bow. A kicker step 30*b* is provided on the portion of the guide member 18 in horizontally opposed relation to the arrow rest 36 as best shown in FIG. 4. This step 30*b* guides or kicks the arrow outwardly from the guide 18 and provides clearance for the guide member below the arrow rest as illustrated.

It will be seen that I have provided a relatively simple, yet extremely efficient bow-mounted arrow quiver which provides a readily accessible supply of arrows which can be very quickly brought into notched sighting position on the bow for rapid fire shooting of all of the arrows contained in the magazine.

What is claimed is:

1. In combination with a bow having a front convex side and a rear concave side with a bow string connected to the ends thereof and positioned on the concave rear side of the bow and an arrow rest located on a projection side of the bow where the arrow is located during the drawing, sighting, and releasing operations, a bow-mounted quiver adapted to provide a supply of arrows positioned in close proximity to the sighting and projection path of arrows to permit rapid fire shooting of all arrows stored in the quiver, said quiver comprising, a magazine having a tip arrow-holding clip member with arrow-holding recesses formed therein and a bottom clip member spaced below said top clip member and having arrow-holding recesses formed therein, said top clip member being disposed, when mounting on a bow, in forwardly and upwardly spaced relation to said bottom clip member with both of said clip members being cantilevered from the projection or arrow rest side of the bow to provide clearance for shifting arrows from their recesses on said magazine toward the projection side of the bow into sighting projection position when released from said clip members prior to notching of an arrow, and means for mounting said magazine in operative position on said bow.

2. The structure set forth in claim 1 and a guide member extending inwardly toward the bow from a position disposed outwardly of the bottom clip member to engage an intermediate portion of each arrow as the archer removes the same from the clip members and shifts an arrow into notched sighting and projection position.

3. The structure set forth in claim 2 wherein said guide member is fixed to an upper portion of the bottom clip member and extends downwardly therefrom to the bow substantially adjacent to the sighting projection position of an arrow on the bow.

4. The structure set forth in claim 2 and a kicker step formed on the lower portion of said guiding member substantially adjacent to the sighting projection position of an arrow on the bow.

5. The structure set forth in claim 4 wherein the bottom of said top clip member and the top of said bottom clip member of the magazine are spaced apart to provide an opening through which the bow can be received to permit the attachment bracket to be mounted on the non-projection side of the bow and permit the magazine to be located in its operative position on the projection side of the bow.

6. The structure set forth in claim 1 and a pair of supporting arms with bracket means connected thereto for connecting said arms to the bow, one of said supporting arms being fixed to the top clip member and the other being fixed to the bottom clip member to provide a unitary structure to facilitate attachment to the bow.

7. The structure set forth in claim 6 and said bracket means including a mounting plate with vertically elongated slots formed therein to receive a clamping screw therethrough and permit vertical adjustment of the bracket means and arms on the bow.

8. The structure set forth in claim 6 and a mounting plate including at least one generally laterally oriented elongated slot formed therein to permit angular rotation of the bracket means on the bow for adjustment of the angle of the magazine and also permit the upper part of the magazine to be rotated toward and away from the bow to facilitate angular adjustment and retraction of the magazine into storage position.

9. The structure set forth in claim 6 and means associated with said bracket means for permitting vertical adjustment of the bracket means on said bow.

10. The structure set forth in claim 6 and means for permitting the magazine to be rotated into retracted position to lie substantially adjacent to the bow for compact storage.

11. The structure set forth in claim 1 and a cross bar carried by said magazine in spaced relation to the top clip member and lying substantially in the plane defined by arrows being held in said clip members wherebby removal of arrows from the recesses in the bottom clip member will cause fulcrumming engagement of the cross bar with a removed arrow to cam the arrow out of its recess in the top clip member substantially simultaneously with the manual release of a removed arrow from the bottom clip member.

12. The structure set forth in claim 11 wherein the recesses of the top clip member face downwardly and the recesses of the bottom clip member face upwardly, a cross bar is positioned in downwardly spaced relation to the upper clip member, whereby lifting an arrow out of its recess in the bottom clip member will cause the forward portion of an arrow to be fulcrummed out of its downwardly facing upper recess by engagement with said cross bar.

13. The structure set forth in claim 11 and guiding means for guiding each arrow downwardly and inwardly from the magazine toward the sighting and projection position adjacent to the bow, during the notching of an arrow after its release from the clip members.

14. A method for transferring arrows from a bow-mounted magazine into sighting and projection position on a bow, positioning the magazine on the projection or arrow supporting side of the bow, removing arrows from the recesses provided in said magazine by initially removing the rear portion of an arrow from its bottom recess and removing the forward portion of the arrow from its upper recess and manually holding a removed arrow, after its release from said recesses and stabilizing a removed arrow while it slides down a guide to an arrow projection position on the bow where it is caused to be engaged with a bowstring in the bow string.

* * * * *